US007980092B2

(12) United States Patent
Fournier

(10) Patent No.: US 7,980,092 B2
(45) Date of Patent: Jul. 19, 2011

(54) COMPRESSOR

(75) Inventor: David John Fournier, Maple (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 0 days.

(21) Appl. No.: 12/700,152

(22) Filed: Feb. 4, 2010

(65) Prior Publication Data

US 2010/0126691 A1 May 27, 2010

Related U.S. Application Data

(62) Division of application No. 11/564,908, filed on Nov. 30, 2006, now abandoned.

(51) Int. Cl.
*F25D 11/00* (2006.01)

(52) U.S. Cl. ..... 62/430

(58) Field of Classification Search ..... 62/430, 62/238.3, 467, 476, 335
See application file for complete search history.

(56) References Cited

U.S. PATENT DOCUMENTS

| | | | | |
|---|---|---|---|---|
| 3,796,045 | A | 3/1974 | Foster-Pegg | |
| 3,947,146 | A | 3/1976 | Schuster | |
| 3,990,245 | A | 11/1976 | Hellemann | |
| 4,265,397 | A | 5/1981 | Rannenberg | |
| 4,279,574 | A * | 7/1981 | Kunderman | 417/243 |
| 4,407,142 | A | 10/1983 | O'Reilly | |
| 4,420,950 | A | 12/1983 | Bodas et al. | |
| 4,461,154 | A | 7/1984 | Allam | |
| 4,936,109 | A * | 6/1990 | Longardner | 62/238.3 |
| 5,555,745 | A | 9/1996 | Agahi et al. | |
| 5,678,401 | A | 10/1997 | Kimura | |
| 2004/0237527 | A1 | 12/2004 | Kato et al. | |

FOREIGN PATENT DOCUMENTS

EP 1793111 A1 6/2007

* cited by examiner

*Primary Examiner* — Melvin Jones
(74) *Attorney, Agent, or Firm* — Husky Intellectual Property Services

(57) ABSTRACT

Disclosed, amongst other things, is a compressor, a heat recovery device, and a plant, configured to practice heat recovery from a compressible media for performing useful work in driving a heat-driven chiller.

15 Claims, 3 Drawing Sheets

COMPRESSOR

CROSS REFERENCE TO RELATED APPLICATION

This application is a divisional of U.S. patent application Ser. No. 11/564,908 filed Nov. 30, 2006, the entire disclosure of which is incorporated herein by reference thereto.

TECHNICAL FIELD

The present invention generally relates to, but is not limited to, heat recovery from a compressor for driving a heat-driven chiller, and more specifically the present invention relates to, but is not limited to, (i) a compressor, (ii) a heat recovery device, and (iii) a plant, amongst other things.

BACKGROUND

Much of the energy used by a typical industrial compressor for compressing a compressible media, such as an air, is converted into heat.

Typically, the waste heat is removed by a compressor heat exchanger (i.e. inter-cooler or after-cooler). The compressor heat exchanger is typically water or air cooled. The waste heat is typically rejected to a suitable heat sink such as a cooling tower, a cold water source (e.g. local water body for direct cooling), or to the outside air. Otherwise, the waste heat may be used in applications including process use, indoor space heating, pre-heating boiler water and so forth.

Plants requiring a source of a compressed media may also require a source of chilled coolant (such as water or glycol). For example, compressed air and chilled coolant is used extensively in the production of thermoplastic bottles (e.g. the processes of: injection molding, extrusion molding, or blow-molding, etc.). Other examples may include metal working, die casting, chemical processing, pharmaceutical formulation, food and beverage processing, power supply and power generation stations, analytical equipment, semi-conductor production, to name just a few.

The power requirements, such as electricity, for operating both compressors and vapor-compression-type chillers are typically very high. Plant operators stand to benefit enormously if the costs of operating their process equipment could be reduced.

SUMMARY

According to a first aspect of the present invention, there is provided a compressor including a heat recovery heat exchanger. The heat recovery heat exchanger configured in a heat recovery branch to recover at least a portion of an excess heat in a compressible media as a recovered heat. The heat recovery heat exchanger configured to thermally connect with a heat-driven coolant chiller wherein at least a portion of the recovered heat is used to drive the coolant chiller.

According to a second aspect of the present invention, there is provided a heat recovery device including a heat recovery heat exchanger. The heat recovery heat exchanger configured to connect in a heat recovery branch of a compressor to recover at least a portion of an excess heat in a compressible media. The heat recovery heat exchanger configured to thermally connect with a heat-driven coolant chiller wherein at least a portion of the recovered heat is used to drive the coolant chiller.

According to a third aspect of the present invention, there is provided a plant including a compressor for compressing a compressible media and a heat recovery heat exchanger. The heat recovery heat exchanger configured in a heat recovery branch to recover at least a portion of an excess heat in the compressible media as a recovered heat. The plant further includes a heat-driven coolant chiller. The heat recovery heat exchanger configured to thermally connect with the heat-driven coolant chiller wherein at least a portion of the recovered heat is used to drive the coolant chiller.

A technical effect, amongst others, of the aspects of the present invention is the conversion of the waste heat energy from a compressible media to drive a heat-driven coolant chiller (e.g. an adsorption or an absorption-type chiller). Accordingly the chilled coolant produced by recovered heat reduces the overall power (i.e. electricity) required to operate the plant.

Preferable embodiments of the present invention are subject of the dependent claims.

BRIEF DESCRIPTION OF THE DRAWINGS

A better understanding of the exemplary embodiments of the present invention (including alternatives and/or variations thereof) may be obtained with reference to the detailed description of the exemplary embodiments along with the following drawings, in which.

The drawings are not necessarily to scale and are may be illustrated by phantom lines, diagrammatic representations and fragmentary views. In certain instances, details that are not necessary for an understanding of the exemplary embodiments or that render other details difficult to perceive may have been omitted.

DETAILED DESCRIPTION OF THE EXEMPLARY EMBODIMENTS

Figure 1:
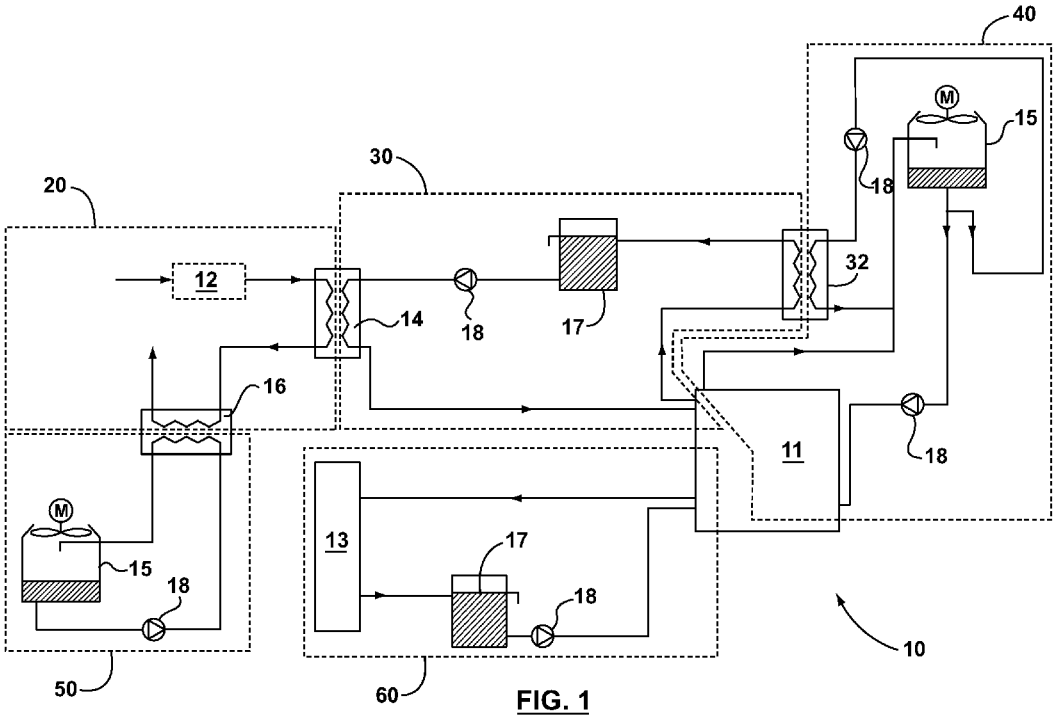
FIG. 1 is a simplified schematic representation of a plant according to a first exemplary embodiment (which is the preferred embodiment)

With reference to FIG. 1, a simplified schematic representation of a plant 10 according to a first exemplary embodiment is shown (which is the preferred embodiment).

The plant 10 includes a compressor 12 arranged in a heat recovery branch 20 for recovering at least a portion of an excess heat in a compressible media as recovered heat. The excess heat to be recovered may have been imparted to the compressible media by various means including the internal energy added to the compressible media by a mechanical work of compression thereof by the compressor 12. The excess heat is preferably an amount of heat in the compressible media to be removed for an efficient operation of a downstream compressor stage or other device or process working with the compressed media (e.g. compressed air dryer, molding system, etc.). Accordingly, the heat recovery branch 20 includes a heat recovery heat exchanger 14 for recovering the excess heat. In the preferred embodiment the compressible media is passed directly through the heat recovery heat exchanger 14. The plant 10 further includes a heat-driven coolant chiller 11 thermally connected to the heat recovery heat exchanger 14 wherein at least a portion of the recovered heat is used to drive the coolant chiller 11.

Preferably, the thermal connection between the heat recovery heat exchanger and the heat-driven chiller 11 is controllable such that the chiller 11 receives only as much heat as it requires for efficient operation thereof. Accordingly, with seasonal availability of free cooling (e.g. to a cold ambient outdoor environment) the continued operation of the heat-driven chiller may become unnecessary, and hence the heat recovery heat exchanger 14 and the chiller 11 may be thermally isolated. During such periods of minimal chiller demand the heat recovery heat exchanger 14 is preferably thermally connected to another heat-driven load. For instance, the heat-driven load may include space-heating.

The compressor 12 may be any type of compressor (e.g. reciprocating, rotary screw, or rotary centrifugal). The compressor may include a single compressor stage, or may include any number of compressor stages. Accordingly, the heat recovery may be performed between compressor stages (inter-cooler) or at the exit of the compressor (after-cooler).

The compressible media may be a fluid or a gas (e.g. such as air).

The plant 10 may be of any type requiring supplies of both the compressible media and a source of chilled coolant. For example, the plant 10 may be a blow-molding plant producing plastic bottles. A typical bottle blowing plant requires large volumes of a compressed gas (e.g. air) for performing a step of pressure-expansion of a heated (and hence malleable) preform or parison, as well as a large volume of chilled coolant (e.g. water) for cooling of the bottle molds. Traditionally, compressed air for a blow-molding plant was provided by ganging together a low-pressure compressor (e.g. rotary screw) together with a high-pressure compressor (i.e. booster). More recently, single-unit multi-stage compressor (e.g. centrifugal or piston) have become popular.

Figure 2:
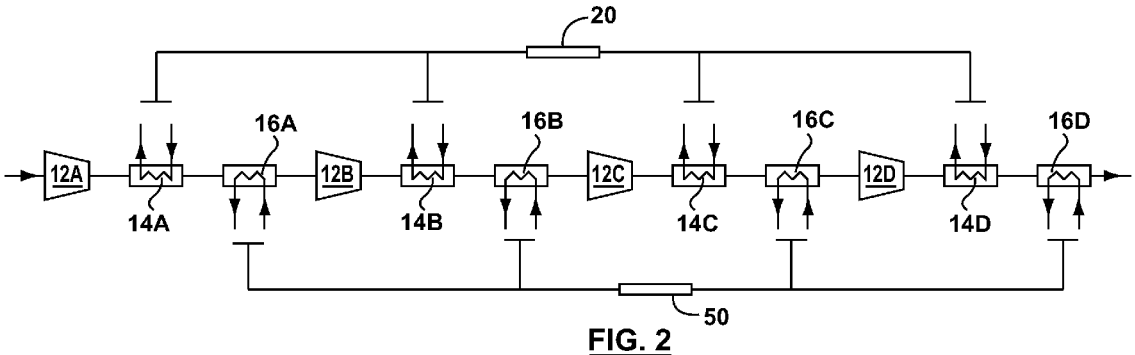
FIG. 2 is a simplified schematic representation of a compressor for use in the plant according to the first exemplary embodiment.

With reference to FIG. 2, a four-stage compressor of the type suitable for use in a blow-molding plant is shown that has been modified to include an exemplary embodiment of the heat recovery device 14 of the present invention. In particular, a heat recovery heat exchanger 14 is preferably configured in-line between a compressible media outlet of the compressor stages 12A, 12B, 12C, and 12D and the existing compressor heat exchanger 16A, 16B, 16C, 16D supplied with the compressor, if equipped. The heat recovery heat exchanger 14 is preferably configured to provide heat-carrying media at a required temperature for optimal operation of the associated heat-driven chiller 11. The compressor heat exchangers 16A, 16B, 16C, are inter-coolers, whereas 16D is an after-cooler. The compressor heat exchangers 16A, 16B, 16C, and 16D are as configured by the compressor manufacturer for connection to a suitable heat sink (e.g. cooling tower). However, instead of removing all of the excess heat through the compressor heat exchangers 16A, 16B, 16C, 16D, as waste heat, as intended by the manufacturer, the compressor heat exchangers 16A, 16B, 16C, and 16D are configured to trim excess heat that was not recovered by the heat recovery heat exchangers 14A, 14B, 14C, and 14D. Trimming of the excess heat is useful in controlling the temperature of the compressible media for sake of maintaining optimal compressor or process efficiency. Accordingly, in the exemplary embodiment the compressor heat exchangers 16A, 16B, 16C, and 16D are thermally connected into a trim cooling loop 50 having a heat sink to reject the waste heat. The exemplary trim cooling loop 50, FIG. 1, includes a pump 18 for re-circulating a heat-carrying media (such as water or glycol) between the compressor heat exchangers 16A, 16B, 16C, and 16D and a cooling tower 15 (i.e. heat sink).

Referring back to FIG. 1, the plant 10 further includes a regeneration loop 30 thermally connecting the heat recovery heat exchanger 14 and the heat-driven chiller 11. The exemplary regeneration loop 30 includes a pump 18 for re-circulating a heat-carrying media (such as water or oil) between the recovery heat exchanger 14 and the heat-driven chiller 11. The regeneration loop 30 is also preferably thermally connected to a heat sink for controlling the heat-carrying media temperature at the inlet of the heat recovery heat exchanger 14. Accordingly, the exemplary regeneration loop 30 preferably includes a regeneration loop trim heat exchanger 32 for thermally connecting the regeneration loop 30 with a condenser loop 40 wherein a remaining portion of the recovered heat in the heat-carrying media that is not used to drive the coolant chiller 11 may be rejected. Preferably, a media tank 17 separates the trim recovery heat exchanger 32 and the inlet to the heat recovery heat exchanger 14 for further controlling the temperature of the heat-carrying media at the inlet of the heat recovery heat exchanger 14. The accurate control of the temperature of the heat-carrying media provides for optimal efficiency of the heat-driven chiller 11 by matching its heat input temperature requirements. Typical absorption and adsorption-type heat-driven chillers 11 typically have tight heat input temperature requirements for sake of achieving optimal operating efficiency. For example, typical adsorption-type chillers available from the NISHIYODO KUCHOU MANUFACTURING COMPANY require a heat input temperature of 90° C. (194° F.).

Alternatively, the plant 10 may include an open flow structure thermally connecting the heat recovery heat exchanger 14 and the heat-driven chiller 11 whereby the heat-carrier media flowable through the open flow structure is not re-circulated. For example, the open flow structure may be a duct, and the heat-carrying media may include a gas such as air. In operation, air that is heated by passage through the heat recovery heat exchanger 14 is directed by the air duct to a heat exchanger (not shown) of the heat-driven chiller 11. Alternatively, the heat recovery heat exchanger 14 may be configured in the chiller 11.

The condenser loop 40 is otherwise configured for thermally connecting the heat-driven chiller 11 with a heat sink. The exemplary condenser cooling loop 40 includes a pump 18 for re-circulating a heat-carrying media (such as water or glycol) between the heat-driven chiller 11 and a cooling tower 15 (i.e. heat sink).

The plant 10 further includes a chilled water loop 60 thermally connecting the heat-driven chiller 11 with a chiller load 13. Exemplary embodiments of the chiller load 13 include the device or process to be cooled, such as a molding system (e.g. blow-molding, injection molding, extrusion molding, etc.), air conditioning, dehumidification, or a chilled water tank (i.e. reservoir).

Alternatively, the compressor 12 may include a number of heat recovery heat exchangers 14 configured at a compressible media outlet (i.e. inter-cooler or after-cooler), to recover heat within different temperature ranges. For example, a pair of heat recovery heat exchangers may be configured in-line between the compressible media outlet of a compressor and the compressor heat exchanger 16. In such an arrangement the first heat recovery heat exchanger may be configured to remove a high-temperature heat, while the second a mid-temperature heat, whereas the low-temperature waste heat may be rejected through the compressor heat exchanger 16. Accordingly, the high-temperature heat could be used to drive a first heat-driven load (i.e. plant process and/or device), whereas the mid-temperature heat could be used to drive a second heat-driven load (i.e. plant process and/or device). An example of a plant having both a high-temperature and a mid-temperature process and/or device may include an injection molding plant having a desiccant-type thermoplastic resin dryer wherein the high-temperature heat may be used to regenerate the desiccant bed, whereas the mid-temperature heat may be used to drive the heat-driven chiller 11 for supplying chilled coolant to the injection molds.

Figure 3:
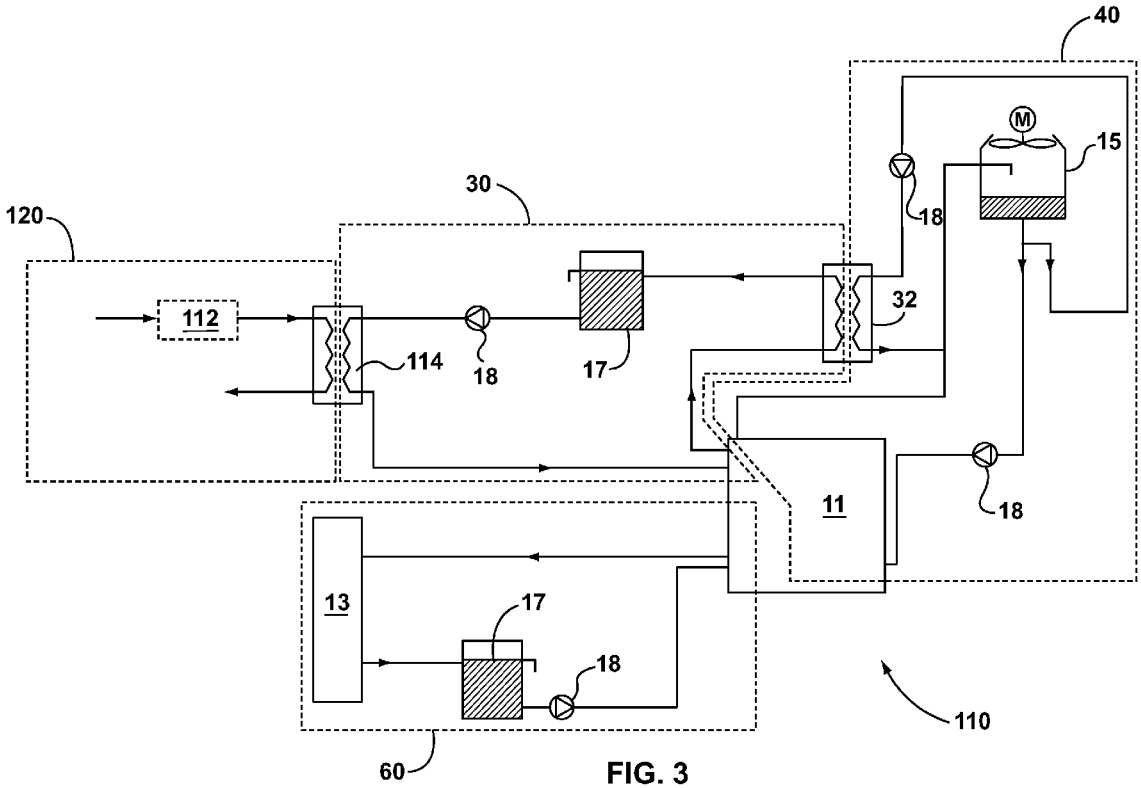
FIG. 3 is a simplified schematic representation of a plant according to a second exemplary embodiment.

Referring to FIG. 3, a second exemplary alternative embodiment of the plant 110 is shown that is configured for heat recovery from a compressor 112 having an integral heat recovery device for sake of driving a heat-driven chiller 11. More particularly, the compressor 112 is configured for heat recovery using only a heat recovery heat exchanger 114 (i.e. the heat recovery heat exchanger performs the functions of both the heat recovery heat exchanger 14 and the compressor heat exchanger 16 of the first embodiment).

Figure 4:
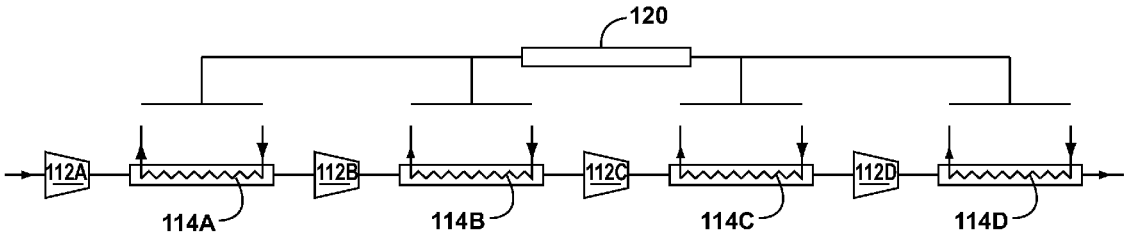
FIG. 4 is a simplified schematic representation of a compressor for use in the plant according to the second exemplary embodiment.

With reference to FIG. 4, the compressor 112 is shown having a heat recovery heat exchanger 114 configured in-line between adjacent compressible media outlet and inlets of the compressor stages 112A, 112B, 112C, as inter-coolers, and at the outlet of the last compressor stage 112D, as an after-cooler. Accordingly, each heat recovery heat exchanger 114 is configured to recover all the excess heat available at the particular compressor stage while maintaining proper inlet conditions for the next compressor stage. Accordingly, the regeneration loop 30 relies upon a thermal connection to a heat sink for rejecting any waste heat not used by the heat-driven chiller 11. Accordingly, the exemplary regeneration loop 30 (FIG. 3) preferably includes a regeneration loop trim heat exchanger 32 for thermally connecting the regeneration loop 30 with a condenser loop 40 wherein a remaining portion of the recovered heat that is not used to drive the coolant chiller 11 may be rejected. Preferably, a media tank 17 separates the trim recovery heat exchanger 32 and the inlet to the heat recovery heat exchanger 114 for further controlling the temperature of the heat-carrying media at the inlet of the heat recovery heat exchanger 114. Accordingly, the temperature of the heat-carrying media in the regeneration loop 30 is preferably controlled for providing optimal heat-carrying media temperature at the inlet of both the heat-driven chiller 11 and the heat recovery heat exchanger 114 for optimal efficient operation of the compressor 112 and the heat-driven chiller 11.

Alternatively, the regeneration loop 30 heat exchanger may be connected to a dedicated trim cooling loop (not shown) in place of the thermal connection with the condenser loop 40.

The description of the exemplary embodiments provides examples of the present invention, and these examples do not limit the scope of the present invention. It is understood that the scope of the present invention is limited by the claims. The concepts described above may be adapted for specific conditions and/or functions, and may be further extended to a variety of other applications that are within the scope of the present invention. Having thus described the exemplary embodiments, it will be apparent that modifications and enhancements are possible without departing from the concepts as described. Therefore, what is to be protected by way of letters patent are limited only by the scope of the following claims:

What is claimed is:

1. A plant, comprising:

a compressor for compressing a compressible media;

a heat recovery heat exchanger;

the heat recovery heat exchanger configured in a heat recovery branch to recover at least a portion of an excess heat in the compressible media as a recovered heat;

a heat-driven coolant chiller;

the heat recovery heat exchanger configured to thermally connect with the heat-driven coolant chiller wherein at least a portion of the recovered heat is used to drive the heat-driven coolant chiller;

a heat sink;

the compressor further includes a compressor heat exchanger configured to recover a remaining portion of the excess heat in the compressible media as waste heat, the compressor heat exchanger being configured to connect with the heat sink to reject the waste heat;

the compressor includes a compressible media outlet, wherein a plurality of the heat recovery heat exchangers, including the heat recovery heat exchanger, are arranged in-line between the compressible media outlet and the compressor heat exchanger;

the plurality of heat recovery heat exchangers includes:

a first heat recovery heat exchanger configured to recover a high-temperature portion of the excess heat for driving a first heat-driven load; and a second heat recovery heat exchanger configure to recover a mid-temperature portion of the excess heat for driving a second heat-driven load;

wherein one of the first heat-driven load and the second heat-driven load include the heat-driven coolant chiller.

2. The plant of claim 1, further comprising:

a regeneration loop;

the heat recovery heat exchanger configured to connect with the regeneration loop, a heat-carrier media circulatable within the regeneration loop for thermally connecting the heat recovery heat exchanger and the heat-driven coolant chiller.

3. The plant of claim 1, further comprising:

an open flow structure;

the heat recovery heat exchanger configured to connect with the open flow structure, a heat-carrier media flowable through the open flow structure for thermally connecting the heat recovery heat exchanger and the heat-driven coolant chiller.

4. The plant of claim 2, wherein:

the heat-carrier media comprises one of a fluid or a gas.

5. The plant of claim 4, wherein:

the fluid comprises at least one of water, glycol, or oil.

6. The plant of claim 1, wherein:

the compressible media comprises one of a fluid or a gas.

7. The plant of claim 6, wherein:

the gas comprises air.

8. The plant of claim 2, wherein:

the heat recovery heat exchanger configured to recover all of the excess heat.

9. The plant of claim 2, further comprising:

a heat sink;

the heat recovery heat exchanger configured to connect with the heat sink to remove a remaining portion of the recovered heat that is not used to drive the heat-driven coolant chiller.

10. The plant of claim 9, wherein:

the heat sink comprises a condenser loop connected to the regeneration loop through a regeneration loop heat exchanger.

11. The plant of claim 1, wherein:

the heat sink comprises a trim cooling loop.

12. The plant of claim 1, further comprising:

a plurality of compressor stages;

the heat recovery heat exchanger configured between at least one of adjacent compressor stages.

13. The plant of claim 1, further comprising:

a chiller load;

a chilled water loop thermally connecting the heat-driven coolant chiller with the chiller load.

14. The plant of claim 13, wherein:

the chiller load comprises at least one of:

a chilled water tank;

a molding system.

15. The plant of claim 1, wherein:

the thermal connection between the heat recovery heat exchanger and the heat-driven coolant chiller is controllable;

the heat recovery heat exchanger configured to be controllably thermally connected to another heat-driven load.

* * * * *